United States Patent [19]

Bird

[11] Patent Number: 5,022,442

[45] Date of Patent: Jun. 11, 1991

[54] APPARATUS AND METHOD FOR HIGH PRESSURE GAS MIXING

[75] Inventor: Robert E. Bird, St. Louis, Mo.

[73] Assignee: Acetylene Gas Company, St. Louis, Mo.

[21] Appl. No.: 325,769

[22] Filed: Mar. 20, 1989

[51] Int. Cl.[5] ..... B65B 3/04

[52] U.S. Cl. ..... 141/100; 141/4; 141/9

[58] Field of Search ..... 141/4, 9, 100, 102, 141/104, 105; 222/57, 464, 402.16

[56] References Cited

U.S. PATENT DOCUMENTS

| | | | |
|---|---|---|---|
| 3,656,657 | 4/1972 | Smith et al. | 222/464 X |
| 3,833,029 | 9/1974 | Munn | 141/4 |
| 4,193,515 | 3/1980 | Purdy | 222/57 |
| 4,611,641 | 9/1986 | Carter, Sr. | 141/4 |
| 4,860,803 | 8/1989 | Wells | 141/9 |

*Primary Examiner*—Ernest G. Cusick
*Assistant Examiner*—Casey Jacyna
*Attorney, Agent, or Firm*—Paul M. Denk

[57] ABSTRACT

An apparatus and method for high pressure gas filling of gas cylinders is disclosed. The apparatus includes an elongated filling tube for a pressurized gas cylinder having a valve regulator/fitting sealed in an opening at one end of the gas cylinder, the elongated filling tube extending within the cylinder and being attached at one end to the valve regulator/fitting. The elongated filling tube is provided with longitudinally spaced transverse openings along the length thereof to facilitate intermixing of gases injected into the cylinder under pressure. The method of high pressure gas mixing within a pressurized cylinder includes the steps of injecting a predetermined volume of a first gas under a predetermined pressure into the cylinder, and injecting a remaining volume of at least one other gas under a greater predetermined pressure into the cylinder, while also intermixing the molecules of the first and the at least one other gas together throughout the cylinder in order to produce a desired gas mixture within the pressurized cylinder.

1 Claim, 5 Drawing Sheets

APPARATUS AND METHOD FOR HIGH PRESSURE GAS MIXING

BACKGROUND OF THE INVENTION

The gas products industry ships gases and gas mixtures in carefully constructed metal pressure cylinders, in order to withstand pressure filling/unfilling, as well as transportation and handling of the pressure cylinders between the gas supplier and the gas user. Gases and gas mixtures are injected under pressure from a gas filling manifold into gas cylinders through valve regulators/-fittings which are sealed and mounted to the gas cylinders at an upper end thereof. Manually operated levers or knobs are provided, to close the valve regulators/fittings when the gas cylinders are filled, and for subsequent opening of the valve regulators/fittings, when it is desired to use the gas or gas mixture contents within the cylinder.

When mixing two or more gases, the gas product industry has typically rolled or rotated the gas cylinder following filling, in order to mix the gases. This requires placing the filled gas cylinder in a horizontal position on a series of motor driven rollers which rotate the cylinder for a given period of time, usually about 15 minutes, in order to blend or mix the gas mixture. In many cases, the motor driven motor apparatus has been designed to accommodate a plurality of gas cylinders, i.e., 6 cylinders, in order to simultaneously mix the pressurized gas mixture contents of a number of gas cylinders at the same time.

The intimacy or degree of mixing achieved is directly related to the homogeneity of the mixture. Absolute homogeneity would correspond to theoretically perfect mixing; in actual practice; however, only a certain degree of homogeneity is achieved which is sufficient to fulfill the requirements of the gas products industry. It has been determined, on an empirical basis, that the aforementioned cylinder rolling procedure achieves the desired intermixing of gases, if performed over a given period of time, generally accepted to be a 15 minute time period for the intermixture of most gas products in the gas products industry.

While the above procedure has worked quite well up to the present time, it will be apparent from the following description of the apparatus and method of the present invention that the above described procedure is a time consuming, labor exhausting, and an energy and cost inefficient method, as compared to the apparatus and method of the present invention herein disclosed.

SUMMARY OF THE INVENTION

Among the several objects and advantages of the present invention include:

The provision of an apparatus and method for high pressure gas mixing which overcomes the problem associated with prior art apparatus and methods;

The provision of a new and improved gas cylinder filling apparatus and method which facilitates the intermixing of gases in gas cylinders;

The provision of the aforementioned apparatus and method which requires no additional time to intermix gases following pressure filling of gases in a gas cylinder;

The provision of the aforementioned apparatus and method which provides simultaneous filling and intermixing of gases in a gas cylinder;

The provision of the aforementioned apparatus and method which utilizes no moving parts for simultaneously filling and intermixing a gas mixture within a gas cylinder;

The provision of the aforementioned apparatus and method which maintains a constant gas mixture throughout various pressure filling levels within a gas cylinder;

The provision of the aforementioned apparatus and method which maintains gas products industry high pressure gas mixing standards; is inexpensive to operate and use; provides repeated and continuous filling and intermixing without substantial wear; meets gas products industry safety standards; establishes a new standard of efficiency for high pressure gas mixing; and is otherwise well adapted for the purposes intended.

Briefly stated, the apparatus of the present invention provides, in a pressurized cylinder having a valve regulator sealed in an opening at one end of the cylinder, the improvement comprising an elongated filling tube extending within the cylinder and being attached at one end to the valve regulator, the elongated filling tube having longitudinally spaced transverse openings along the length thereof to facilitate intermixing of gases injected into the cylinder under pressure.

The transverse openings preferably extend throughout opposite sides of the elongated filling tube and are at different circumferentially spaced locations along the length of the elongated filling tube. The elongated filling tube preferably terminates in a free end spaced upwardly from a bottom end of the cylinder.

In one typical example, the elongated filling tube preferably has a 5/16" outside diameter with the transverse openings being approximately ⅛" in diameter and longitudinally spaced approximately 5" from one another, and at perpendicularly staggered positions, along the length of the elongated filling tube. The elongated filling tube may be made from copper and can be attached to the valve regulator such as by silver soldering or the like.

The method of high pressure gas mixing within a pressurized cylinder includes the steps of injecting a predetermined volume of a first gas under a predetermined pressure into the cylinder, and injecting a remaining volume of at least one other gas under a greater predetermined pressure into the cylinder, while also intermixing the molecules of the first and at least one other gas together throughout the cylinder in order to produce a desired gas mixture within the pressurized cylinder. The first and at least one other gas are injected through longitudinally spaced transverse openings in an elongated filling tube mounted within the cylinder.

The first gas may be oxygen ($O_2$) having a predetermined volume of approximately 21% injected under a pressure of approximately 600 psi into the cylinder while the remaining volume may be nitrogen ($N_2$) of approximately 79% volume injected under a pressure of approximately 2200 to 2600 psi into the cylinder.

These and other objects and advantages of the present invention will become more apparent from the ensuing description.

BRIEF DESCRIPTION OF THE DRAWINGS

In the drawings.

Corresponding reference numerals will be used throughout the several figures of the drawings.

DESCRIPTION OF THE PREFERRED EMBODIMENT

The following detailed description illustrates the invention by way of example and not by way of limitation. This description will clearly enable one skilled in the art to make and use the invention, and describes several embodiments, adaptions, variations, alternatives, uses and methods of the invention, including what I presently believe to be the best mode of carrying out the invention.

In the description that follows, the present invention will be described with reference to a specific gas mixture, namely a breathing air gas mixture for human consumption and for use in lab machines, hospitals, nursing homes, or the like, and comprising approximately 21% oxygen ($O_2$) and the remainder approximately 79% nitrogen ($N_2$). It will be understood; however, that the apparatus and method of the present invention may be used for a variety of different gases and gas mixtures for industrial, medical and lab use including gases and mixtures for the following special applications: atomic absorption spectroscopy, gas chromatography, super critical fluid chromatography, gas lazers, medical/biological testing, flame photometry, nuclear counter gases, sterilizing gas, emissions testing, flammability testing, B.T.U. verification and leak detection. While this list of special gas mixture applications is by no means inclusive, it is intended to identify the type and kind of special application gas mixtures with which the apparatus and method of the present invention may be used.

Figure 1:
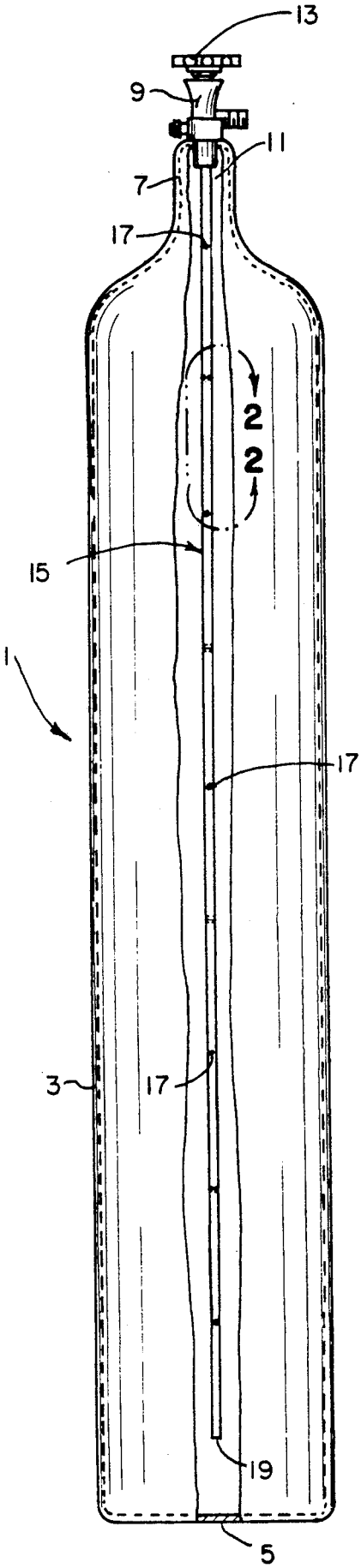
FIG. 1 is a fragmentary side elevational view of a pressurized gas cylinder with a valve regulator/fitting sealed and mounted at an upper end thereof, and showing the elongated filling tube of the present invention connected to the valve regulator/fitting and extending within the gas pressurized cylinder.

For the handling and transportation of gases and gas mixtures, the gas product industry uses hollow metal cylinders, such as the cylinder 1 shown in FIG. 1 of the drawings, including an elongated circumferentially continuous cylindrical side wall 3, a closed bottom end 5, and a restricted or reduced hollow neck area 7 at the upper end of the cylinder 1, in which is mounted a valve regulator or fitting 9. The valve regulator or fitting 9 is typically threadably mounted and sealed within an opening 11 in the restricted or reduced hollow neck area 7 of the cylinder 1, as is common in the industry. Also, the valve regulator or fitting 9 is provided with knobs 13 or equivalent levers (not shown) to open and close the valve regulator or fitting 9 during filling of the cylinder 1, or evacuation of the contents thereof during use of the gas or gas mixture contained within the cylinder 1.

All of the above components are well known in the gas products industry and are used by gas suppliers for filling, transporting and handling various gases and gas mixtures, as may be desired.

As explained above, when two or more gases are injected under high pressure into the cylinder 1, it is the current practice to subsequently roll or rotate a plurality of gas cylinders, usually six in number, by automatic rolling or rotating equipment for a predetermined time period, usually approximately 15 minutes, in order to satisfactorily mix and blend the two or more gases containing the gas mixture. As will be understood, this is a time consuming, and inefficient method of mixing gases, both from the standput of energy output and productivity. By the apparatus and method of the present invention, the aforementioned procedure is totally eliminated and becomes an outdated system, as a result of the specific structural and procedural improvements that are disclosed herein.

According to the present invention, an elongated filling tube 15 is attached at one end to the valve regulator or fitting 9 and extends within the cylinder 1, terminating short of the bottom or end wall 5, as shown in FIG. 1. The elongated filling tube 15 is preferably a copper tube which is attached to the valve regulator or fitting 9, such as by silver soldering or the like.

In actual practice, it has been discovered that a 5/16" outside diameter copper tube with a series of transverse openings 17, approximately ⅛" in diameter, drilled or otherwise formed to extend through opposite sides of the elongated filling tube 17 works quite well. Along the length of the elongated tube 15, the transverse opens 17 are spaced approximately 5" from one another, except within the reduced or restricted neck area 7 where the initial spacing between the valve regulator or fitting 9 and the first transverse opening 17 is approximately 3", as shown in FIG. 1. Also, as shown in FIG. 1, the outer free end 19 of the elongated filling tube 15 is spaced approximately 3" from the lower or bottom end wall 5 of the cylinder 1.

Figure 2:
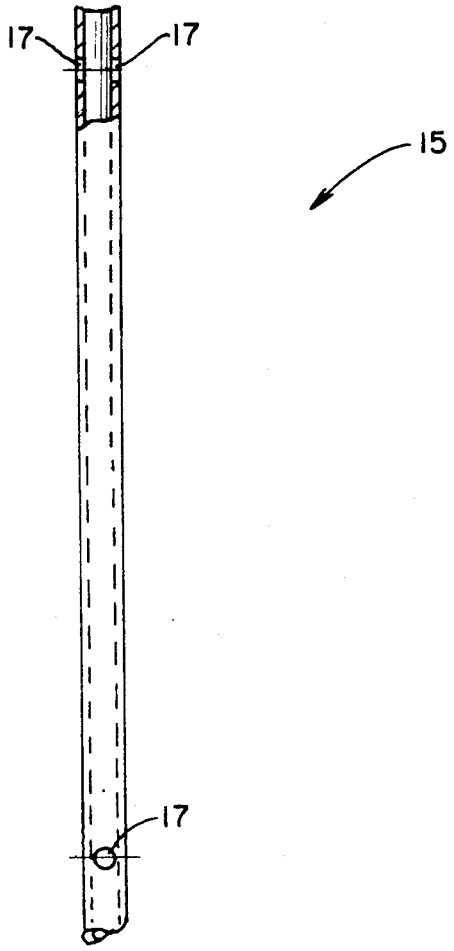
FIG. 2 is an enlarged fragmentary elevational view, partly in section, of the elongated filling tube showing one typical standard size for the diameter of the tube, size of the openings, and approximate distance between the openings.

In addition to the aforementioned longitudinal spacing of the transverse openings 17, it will be seen in FIG. 2 of the drawings that adjacent transverse openings 17 are drilled or otherwise formed in the elongated filling tube 15 at different circumferentially spaced locations along the length of the elongated filling tube 15. This may be accomplished by drilling or otherwise forming adjacent transverse openings at circumferentially spaced locations approximately 90° offset from one another or any other circumferentially spaced offset location, as may be desired.

By providing a elongated filling tube 15 constructed as described above, intermixing or blending of two or more gases injected into the cylinder 1 under high pressure is greatly facilitated. In actual testing, it has been discovered that an elongated filling tube 15 with transverse openings 17 intermixes or blends two or more gases to the same extent as was accomplished by the above described rolling or rotating of cylinders, without the time consuming or inefficient prior art procedures and practices.

EXAMPLE

One specific gas mixture application with which the apparatus and method of the present invention has been used is described below and illustrated in connection with FIGS. 3–6 of the drawings. The specific gas mixture application was breathing air for human consumption and lab machines which comprises a gas mixture of approximately 21% oxygen ($O_2$) and a remaining amount of approximately 79% nitrogen ($N_2$). In this specific gas mixture application example, the cylinder 1 was first filled with approximately 21% of oxygen ($O_2$) under a pressure of approximately 600 psi. (it being understood that the pressure will vary somewhat depending on the temperature at time of filling). The second gas comprising nitrogen ($N_2$) having a remaining volume of approximately 79%, was injected into the cylinder 1 under a pressure of approximately 2200 psi to 2600 psi.

When gas is injected into the cylinder 1 via the elongated filling tube, some of the gas passes through the longitudinally spaced transverse opening 17 in the elongated filling tube 15, while some also flows out through the outer free end 19 of the elongated filling tube 15, at the bottom of the cylinder 1. In the aforementioned specific example of breathing air, the approximate 21% volume of oxygen ($O_2$) is first injected via the elongated filling tube under pressure of approximately 600 psi, and thereafter, the remaining volume of 79% nitrogen ($N_2$) is injected via the elongated filling tube 15 at an injected pressure of approximately 2200 psi to 2600 psi. It has been discovered that the greater predetermined pressure from the second gas nitrogen ($N_2$) causes the molecules of nitrogen ($N_2$) to be intermixed with the molecules of the oxygen ($O_2$) as the higher pressure nitrogen is injected via the elongated filling tube 15, including the transverse opening 17 an outer free end 19 thereof.

Following filling as described above, various pressure tests were made of the aforementioned oxygen and nitrogen gas mixture. The is shown in FIGS. 3–6 of the drawings. Charts shown in FIGS. 3–6 of the drawings are partial fragmentary illustrations of an oxygen ($O_2$) analyzer chart depicting the various tests conducted of the oxygen and nitrogen gas mixture utilizing the elongated filling tube of the present invention, as compared to other devices and techniques.

Figures 3A, 3B:
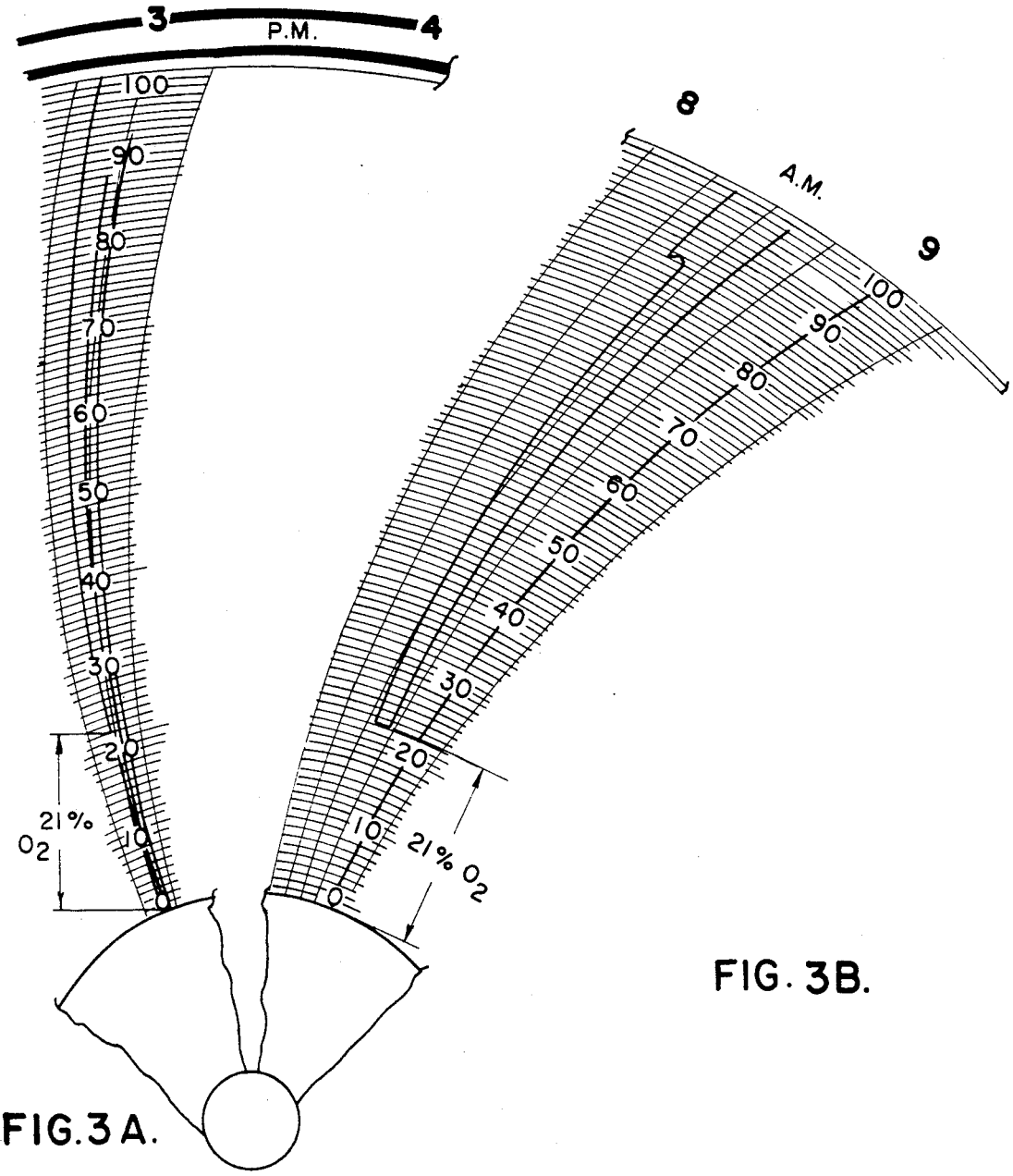
FIG. 3*a* is a fragmentary view of an oxygen ($O_2$) analyzer chart illustrating consistent 21% oxygen ($O_2$) gas mixture when tested at approximately 3:00 p.m. on a specific date.
FIG. 3*b* is a fragmentary view of the same oxygen ($O_2$) analyzer chart showing the same consistent 21% oxygen ($O_2$) gas mixture within a gas cylinder at approximately 8:00 a.m. the next day after the test in FIG. 3*a;*

Specifically, in FIG. 3*a* of the drawings, the oxygen ($O_2$) analyzer chart illustrates that on a test conducted at 3:00 p.m. on a specific date, following filling of the cylinder with oxygen and nitrogen as describe above, the percentage of gas mixture represented by the volume of oxygen ($O_2$) registered 21% of the gas mixture withdrawn from the filled cylinder 1. FIG. 3*b* shows testing of the same cylinder at approximately 8:00 a.m. the next day, and it will be seen that the gas mixture withdrawn from the cylinder, as tested and analysed, continued to show a 21% oxygen ($O_2$) volume in the oxygen and nitrogen gas mixture..

Figure 4:
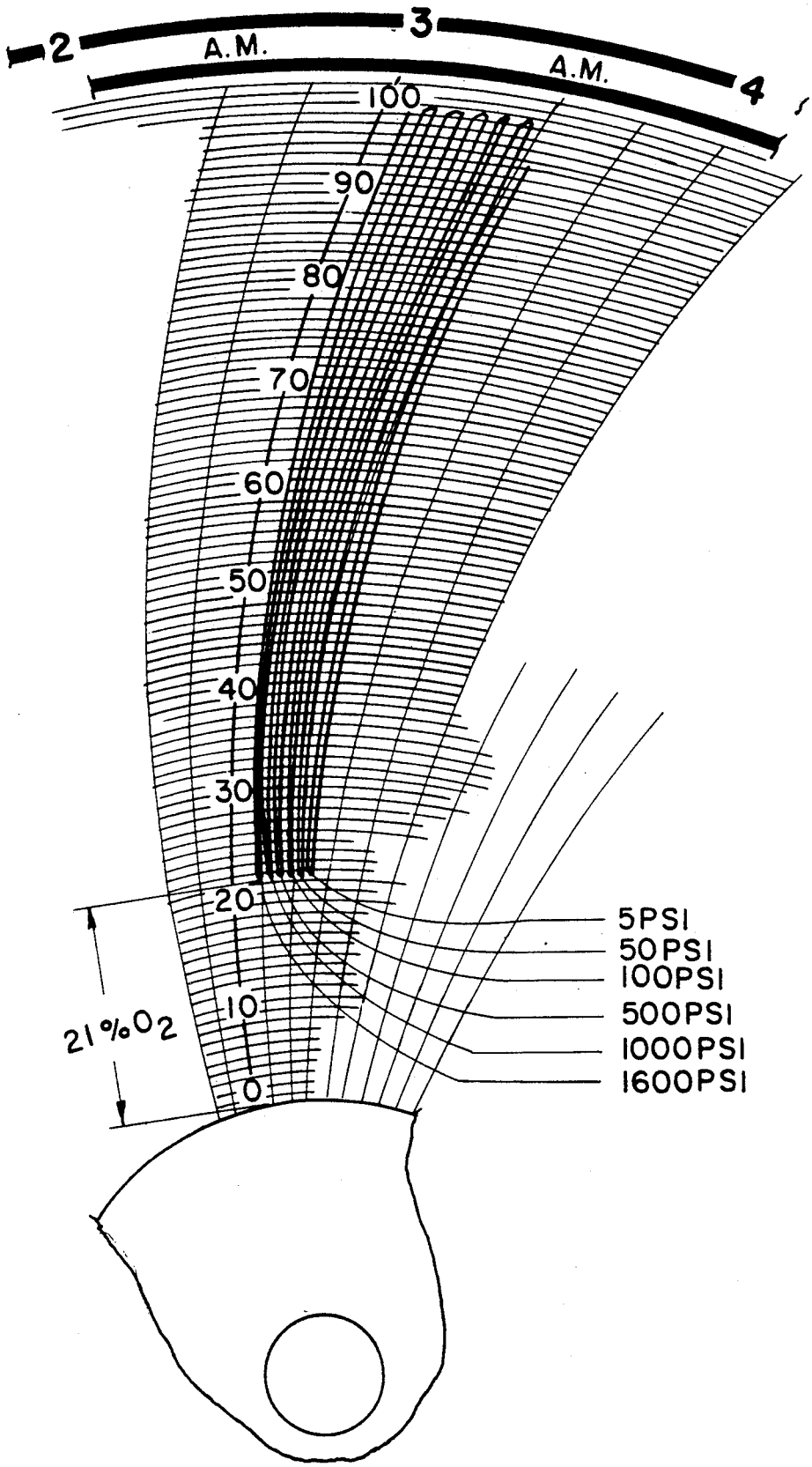
FIG. 4 is a fragmentary view of an oxygen ($O_2$) analyzer chart illustrating a consistent 21% oxygen ($O_2$) and 79% nitrogen ($N_2$) gas mixture within a gas cylinder at various pressure tests of 1600 psi, 1000 psi, 500 psi, 100 psi, 50 psi and 5 psi.

FIG. 4 of the drawings shows an oxygen ($O_2$) analyzer chart illustrating various pressure tests at 1600 psi, 1000 psi, 500 psi, 100 psi, 50 psi and 5 psi of the cylinder containing the oxygen and nitrogen gas mixture, as the mixed gas is tapped for usage and depleted. The chart shows that as the psi pressure was reduced in the cylinder during evacuation of the contents thereof, the same 21% oxygen ($O_2$) volume, as assayed, was maintained in the oxygen and nitrogen gas mixture. This clearly indicates that the apparatus and method of the present invention provides a consistent gas mixture, and in this specific example, was shown to be 21% oxygen ($O_2$) throughout various stages of unfilling or use of the contents of a cylinder filled as described above.

Figure 5:
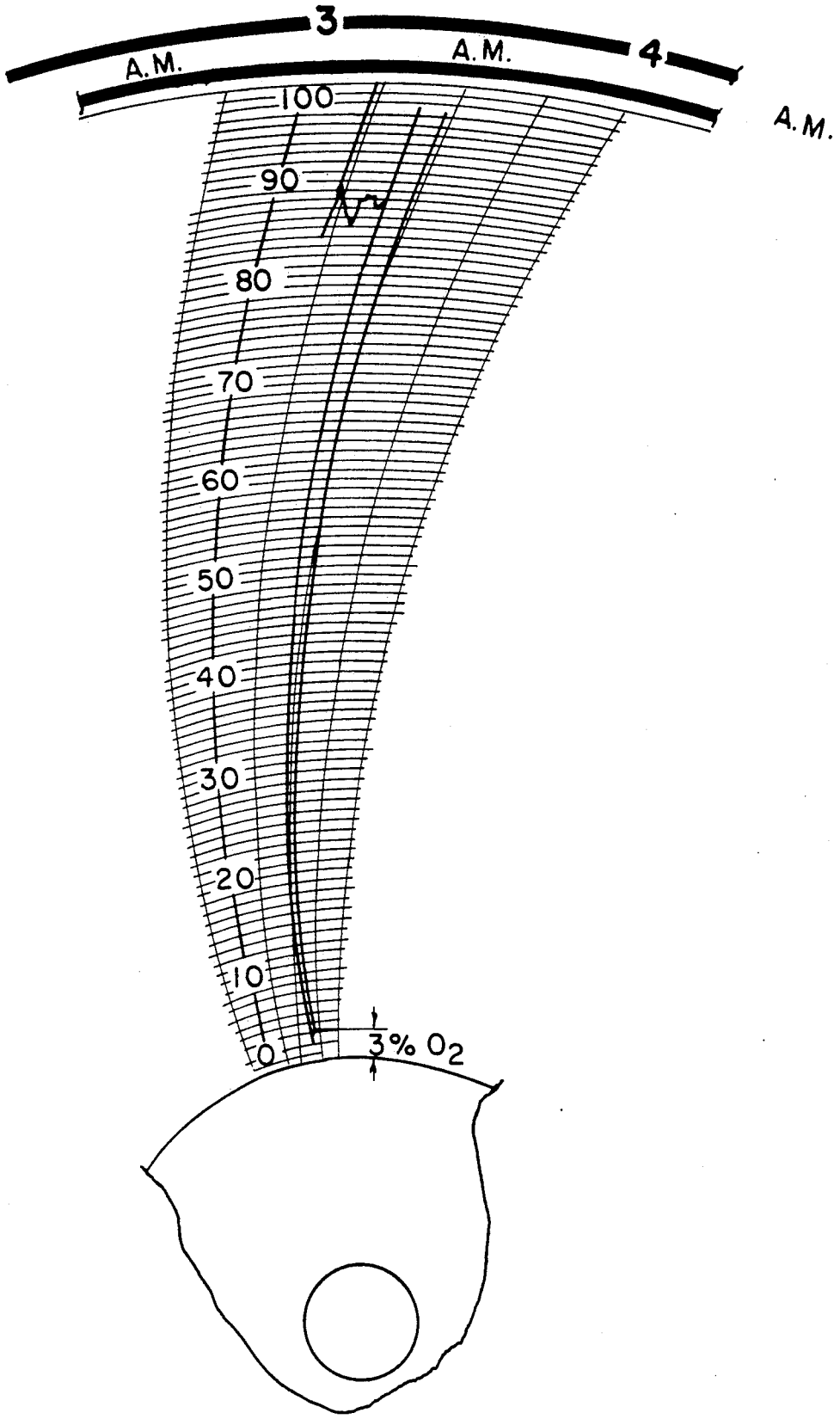
FIG. 5 is a fragmentary view of an oxygen ($O_2$) analyzer chart comparing an elongated filling tube with no transverse holes therein and showing only a 3% oxygen ($O_2$) gas mixture, instead of the desired 21% oxygen ($O_2$) gas mixture.

In FIG. 5, the oxygen analyzer chart shows a 3% oxygen ($O_2$) gas mixture using an elongated filling tube, without longitudinally spaced transverse openings to fill a cylinder 1. In the same way as in previous tests, approximately 21% oxygen ($O_2$) was injected into the cylinder at 600 psi, followed by the remaining volume of approximately 79% nitrogen ($N_2$) injected into the cylinder at 2200 psi to 2600 psi. In this particular case; however, it was discovered that the desired 21% oxygen ($O_2$) mixing did not take place, but rather resulted in only 3% oxygen ($O_2$) mixture in the gas mixture withdrawn from the cylinder during the oxygen analyzer chart testing.

Figure 6:
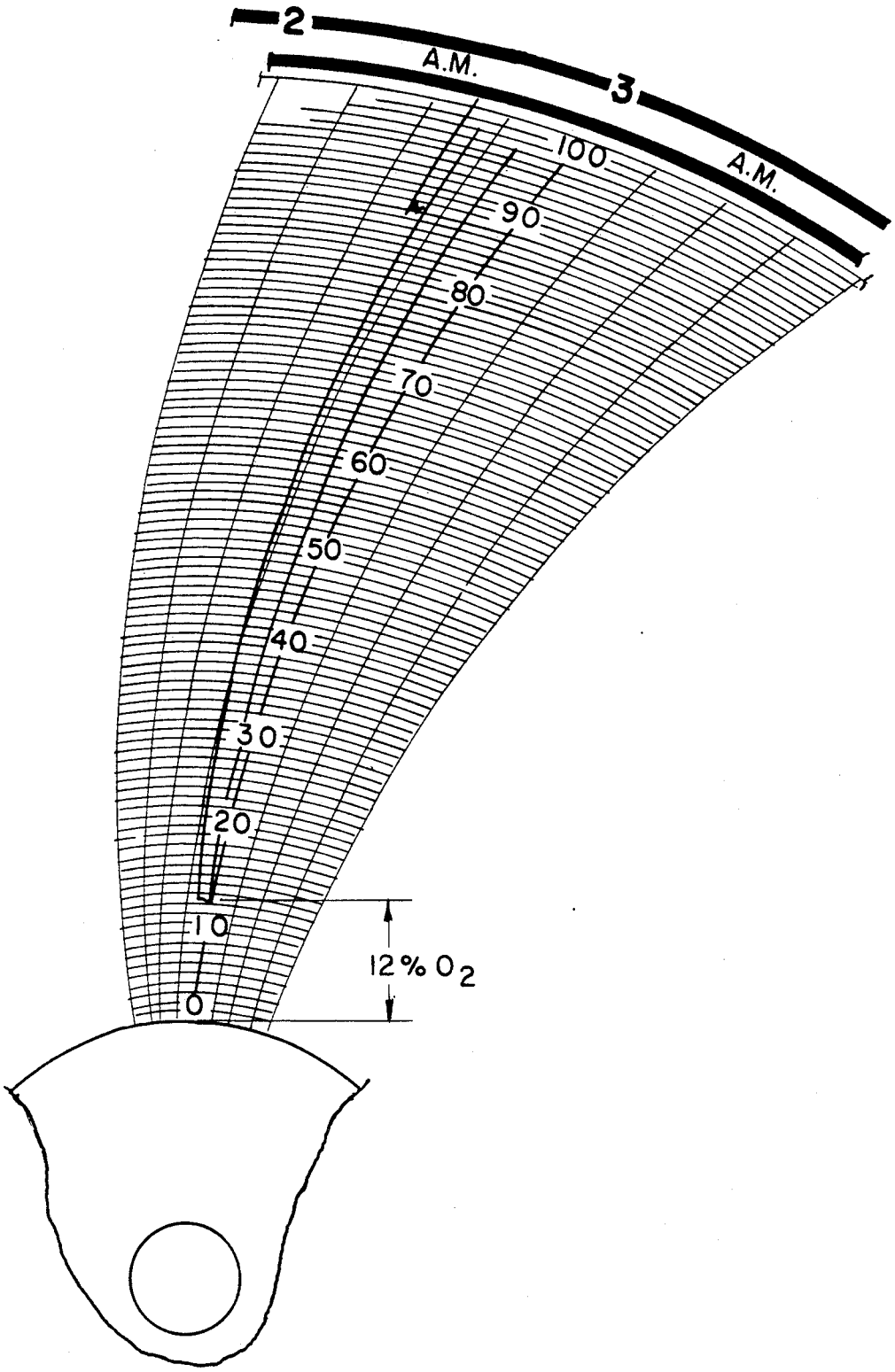
FIG. 6 is a fragmentary view of an oxygen ($O_2$) analyzer chart and showing no use of any elongated filling tube, prior to any rolling or rotation thereof, and illustrating a 12% $O_2$ mixture, instead of the desired 21% gas mixture.

In FIG. 6 of the drawings, approximately 12% oxygen ($O_2$) gas mixture was provided in a cylinder utilizing a regular valve, with no elongated filling tube. This is even though a 21% $O_2$ mix was initially introduced into the cylinder, but never attained adequate mixture. This is the typical filling as currently used in the industry utilizing a valve regulator or fitting 9 only on the cylinder 1. While the 12% oxygen ($O_2$) gas mixture was better than an elongated filling tube without longitudinally spaced transverse openings as shown in FIG. 5, it is clear that both the FIG. 5 and FIG. 6 techniques fall far short of the desired 21% oxygen ($O_2$) gas mixture which automatically results during high pressure mixing of gases using an elongated filling tube 15 with longitudinally spaced transverse openings 17.

From the foregoing, it will be appreciated that the method of high pressure gas mixing within a pressurized gas cylinder, according to the present invention, includes the steps of injecting a predetermined volume of a first gas under a predetermined pressure into the gas cylinder, and thereafter injecting a remaining volume of at least one other gas under a greater predetermined pressure into the gas cylinder while also intermixing the molecules of the first and at lest one other gas together throughout the cylinder in order to produce the desired gas mixture within the pressurized cylinder As will be apparent from the foregoing explanations, the first gas and at least one other gas are injected through longitudinally spaced transverse openings in an elongated filling tube mounted within the cylinder that is attached to the valve regulator or fitting associated therewith. When two or more gases are blended or intermixed as described above, the desired gas mixture will be produced immediately during the filling process, without requiring any time consuming and inefficient subsequent rolling or rotating of the cylinders, as in prior art practices.

It is believed that the concept of this invention for providing a more homogeneous mixture of gases within a pressure cylinder, throughout its extent, and to sustain such mixture even while the gas is being tapped and depleted, can be achieved regardless of the nature of gases being intermixed within the cylinder by the supplier. For example, it is readily known that industrial mixtures of ammonia, boron trichloride, carbon dioxide, carbon monoxide, carbonyl fluoride, carbonyl sulfide, chlorotrifluoroethylene, ethyl chloride, ethylene oxide, the various freons, hydrogen bromide, hydrogen chloride, hydrogen fluoride, hydrogen iodide, hydrogen sulfide, and the various nitrogen and oxygen related gases, and which are all intermixed by the gas supplier, can be more succussfully combined within a pressure cylinder utilizing the teaching of this particular invention. In addition, such can be achieved while obviating the time, labor, and expense consuming practices heretofore utilized by the gas packagers, as previously reviewed.

In view of the above, it will be seen that the several objects of the invention are achieved and other advantageous results are obtained.

As various changes could be made in the above apparatus and method without departing from the scope of the invention, it is intended that all matter contained in the above description or shown in the accompanying drawings should be interpreted as illustrative and not in a limiting sense.

Having thus described the invention, what is claimed and desired to be secured by letters patent is:

1. A pressurized cylinder for use in the mixing of a pair of high pressure gases under predetermined pressure, including a gas cylinder, a valve regulator sealed in an opening at one end of said cylinder, an elongated copper filling tube extending within said cylinder and being attached by silver soldering at one end to said valve regulator, said elongated filling tube termiating at a free end spaced upwardly but proximate to a bottom end of said cylinder, said elongated filling tube having longitudinally spaced transverse openings along the length thereof to facilitate intermixing of gases, said cylinder disposed for reception and containing oxygen and nitrogen gases therein as injected into said cylinder under pressure, said transverse openings extending through opposite sides of said elongated filling tube, said spaced transverse openings are at different circumferentially spaced locations along the length of said elongated filling tube, said elongated filling tube having a 5/16 inch outside diameter, said transverse openings being approximately ⅛ inch in diameter, said transverse openings being spaced approximately five inches from one another along the length of said elongated filling tube, wherein said high pressure gases being injected at predetermined volume sequentially into said pressurized cylinder, said oxygen being injected up to approximately 21% of the capacity of the cylinder under a pressure of approximately 600 psi, and said nitrogen subsequently being injected into the cylinder to a volume of approximately 79% and under a pressure of approximately 2200 to 2600 psi, wherein said intermixed gases within the pressurized cylinder being mixed therein and available for application without requiring any additional mixing or rolling of the pressurized cylinder once filled.

* * * * *